United States Patent [19]

Aust et al.

[11] Patent Number: 4,992,022

[45] Date of Patent: Feb. 12, 1991

[54] SIDE CHANNEL COMPRESSOR

[75] Inventors: Norbert Aust; Rudolf Schoening, both of Bad Neustadt, Fed. Rep. of Germany

[73] Assignee: Siemens Aktiengesellschaft, Berlin & Munich, Fed. Rep. of Germany

[21] Appl. No.: 440,986

[22] Filed: Nov. 22, 1989

[30] Foreign Application Priority Data

Dec. 5, 1988 [EP] European Pat. Off. ..... 88120298

[51] Int. Cl.[5] ..... F04D 29/70

[52] U.S. Cl. ..... 415/121.2; 415/55.1

[58] Field of Search ..... 415/52.1, 55.1, 55.2, 415/55.3, 55.4, 121.2, 169.1

[56] References Cited

U.S. PATENT DOCUMENTS

| | | | |
|---|---|---|---|
| 2,245,094 | 6/1941 | Neibert | 415/55.4 |
| 4,194,798 | 3/1980 | Schonwald et al. | 415/55.1 |
| 4,806,073 | 2/1989 | Schoenwald | 415/55.1 |
| 4,854,830 | 8/1989 | Kozawa et al. | 415/55.1 |
| 4,878,805 | 11/1989 | Hagshenas | 415/169.1 |

FOREIGN PATENT DOCUMENTS

| | | | |
|---|---|---|---|
| 0804394 | 2/1951 | Fed. Rep. of Germany . | |
| 1403579 | 7/1969 | Fed. Rep. of Germany . | |
| 8704066 | 8/1988 | Fed. Rep. of Germany . | |
| 60892 | 5/1981 | Japan | 415/55.1 |
| 171093 | 10/1982 | Japan | 415/55.1 |

*Primary Examiner*—John T. Kwon

*Attorney, Agent, or Firm*—Kenyon & Kenyon

[57] ABSTRACT

A side-channel compressor includes a rotor rotatably supported in the housing of the compressor. The rotor includes a blade ring arranged at the outer circumference of a disk-shaped hub. A clearance space is provided between the housing and the rotor in the region where the rotor hub merges into the blade ring. To prevent the rotor from becoming blocked by dust, lint or fiber-like particles which may settle in the clearance space, at least one recess is formed in the rotor in the region where the hub merges into the blade ring. The recess extends over the entire effective length of the clearance space in the region where the hub merges into the blade ring and effectively expands the boundaries thereof.

4 Claims, 4 Drawing Sheets

SIDE CHANNEL COMPRESSOR

BACKGROUND OF THE INVENTION

The present invention relates to improvements in a side-channel compressor.

Side-channel compressors typically comprise a rotor rotatably supported in a housing, wherein the rotor includes a blade ring arranged at the outer circumference of a disk-shaped hub. A clearance space is provided between the housing and the rotor in the region where the rotor hub merges into the blade ring. Such a side-channel compressor is disclosed in DE-U-87 04 066. This compressor includes a wiper that extends into a narrow radial gap which forms in-part the clearance space. The radial gap is formed between a portion of the blade ring that extends laterally beyond the hub in the direction of the axis of rotation of the rotor and a section of the housing which extends beneath the laterally extending blade ring portion. The wiper strips off dust deposited in the radial gap and thereby prevents clogging thereof and eventual blocking of the rotor. When the gases being conveyed in the side-channel compressor contain sticky or moist dust, the wiper does prevent the rotor from becoming blocked by dust settling in the radial gap. However, the wiper does not prevent the rotor from becoming blocked when the gas being conveyed contains lint or fiber-like particles.

Thus, there is a need to develop a side-channel compressor which also prevents the rotor from becoming blocked by deposits of lint or fiber-like particles in the clearance space between the rotor and the housing when the conveyed gases contain such lint or fiber-like particles.

SUMMARY OF THE INVENTION

The present invention is directed to a side-channel compressor that avoids the problems and disadvantages of the prior art through the provision of at least one recess formed in the rotor in the vicinity where the hub merges into the blade ring. The recess extends the entire effective length of the clearance space formed between the housing and the rotor in the same vicinity and effectively forms an extension of the clearance space. The recess, as well as the clearance space, provides fluid flow communication between the side-channel of the compressor and a cavity which is formed between the hub of the rotor and the housing. Thus, in the vicinity of an outlet orifice of the compressor, leakage gas flows from the side-channel into the cavity. Then, the leakage gas returns from the cavity to the side channel in the vicinity of an inlet orifice of the compressor. However, a more substantial leakage current can develop in the vicinity of the recess. Therefore, leakage gas rapidly flows along the recess. Consequently, dust, lint or fiber-like particles settling in the clearance space are carried away along the recess, before they are able to completely obstruct the clearance space and block the rotor.

In a double-pass design of the side-channel compressor, recesses are provided on both sides of the rotor. Furthermore, the recesses may be circumferentially staggered such as to alternate on opposite sides of the rotor to avoid an unacceptable weakening and corresponding reduction in the mechanical strength of the rotor.

In one embodiment, the blade ring includes a portion which extends laterally beyond at least one side of the hub in the direction of the axis of rotation of the rotor, while the housing includes a section which extends beneath the laterally extending blade ring portion. The laterally extending blade ring portion is spaced from the housing section to form a narrow radial gap. The radial gap together with a narrow axial gap that extends along the disk-shaped hub forms in-part the clearance space. Both gaps are prevented from being obstructed by constructing the recess to include a slit that cooperates with the radial gap and a groove that cooperates with the axial gap. To this end, the slit is provided at the base of a blade cell, which is formed between adjacent blades in the blade ring, while the groove is formed in the disk-shaped hub to extend parallel to the axial gap. Thus, the slit extends to the radial gap and continues to the groove in the region of the axial gap.

Any possible obstruction of the recesses is counteracted through the provision of at least one counterbore in the housing. Each counterbore has an opening facing the axial gap and extends in the circumferential direction, with respect to the disk-shaped hut, a distance several times the width of the groove. This construction causes the leakage gas to undergo turbulent flow.

DETAILED DESCRIPTION

Figure 1:
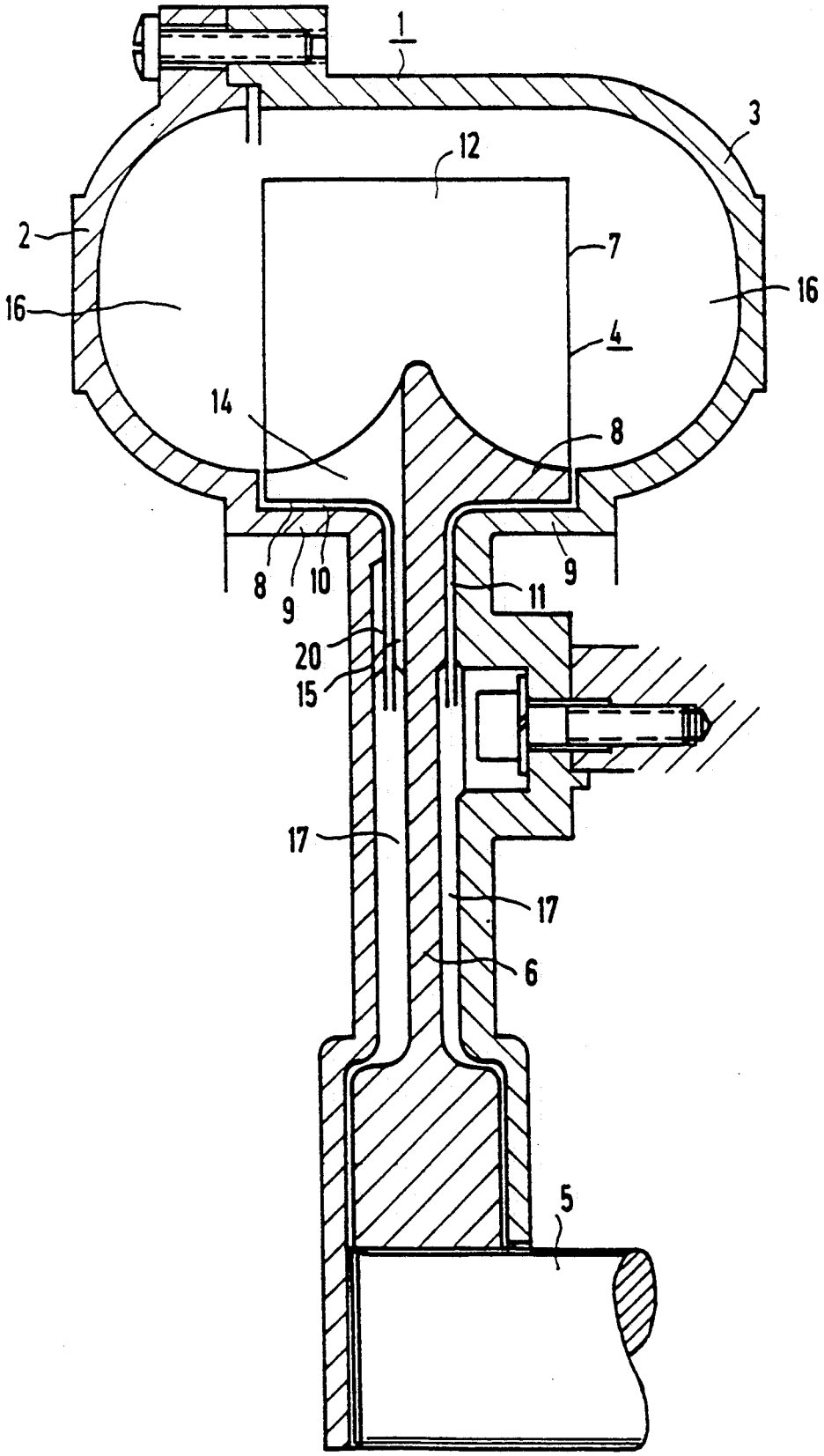
FIG. 1 is a cross-sectional view of an enlarged partial section of a side-channel compressor in accordance with the principles of the invention.

Referring to the drawings wherein like numerals indicate like elements, FIG. 1 shows a section of a side-channel compressor in accordance with the principles of the invention. The compressor comprises housing 1 which includes two housing halves or shell-like members 2 and 3 connected to one another. Impeller or rotor 4 is rotatably supported in housing 1 by shaft 5, which can be coupled to a driving mechanism (not shown in the drawings). As illustrated in FIG. 1, rotor 4 consists of disk-shaped hub portion 6 and blade ring portion 7 arranged at the outer circumference of hub portion 6.

As evident from FIG. 1, blade ring portion 7 extends laterally beyond both sides of hub portion 6 such that blade ring portion 7 is wider than hub portion 6 in the direction of the axis of rotation of rotor 4. Housing halves 2 and 3 are designed in such a manner that they include laterally extending sections 9 that extend below and beyond the laterally extending portions 8 of blade ring portion 7. Furthermore, housing 1 and rotor 4 are spaced to provide a clearance space therebetween. More particularly, housing halves 2 and 3 are dimensioned relative to rotor 4 so that a narrow radial gap 10 is formed between laterally extending portions 8 of blade ring portion 7 and lateral sections 9 of housing halves 2 and 3. Housing 1 also is dimensioned to provide a narrow axial gap 11 between housing 1 and hub portion 6. Such dimensioning provides a clearance space that ensures that rotor 4 rotates within housing 1 in this region without making contact therewith.

Figure 3:
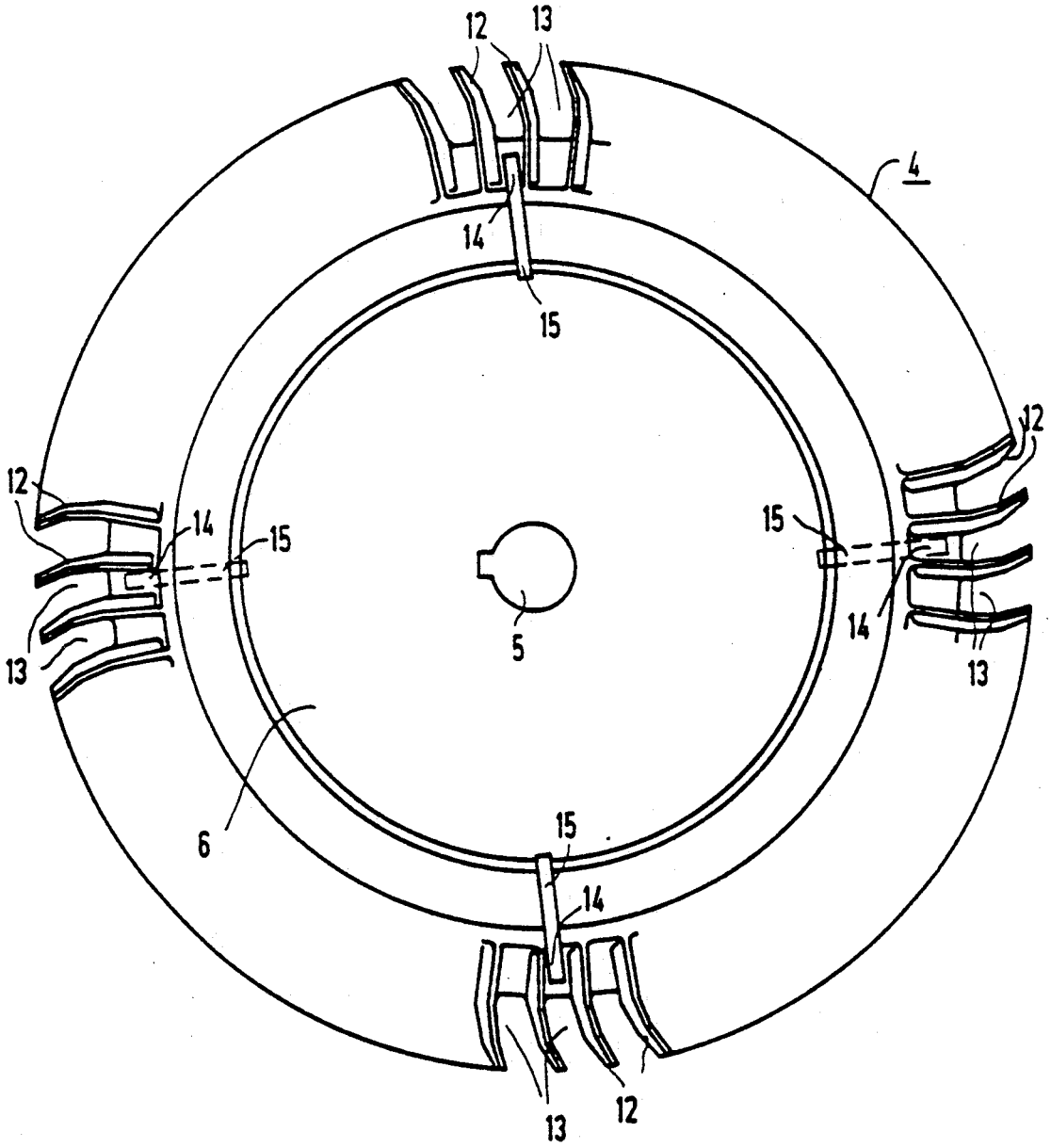
FIG. 3 is a top view of the rotor of the side-channel compressor depicted in FIG. 1.

Referring to FIGS. 1 and 3, blade pockets or cells 13 are formed between individual blades 12 of blade ring portion 7. A slit 14 is provided on the base of several such blade cells 13. Each slit 14 extends to radial gap 10 and groove 15 which extends along hub portion 6 and runs parallel to axial gap 11. Thus, slit 14 and groove 15 form a passageway that provides fluid flow communication between side-channel 16 of the side-channel compressor and cavity 17 which is formed between hub portion 6 and housing 1. As can be understood while viewing FIG. 1, the extent of passageway 14–15 is maximized when slit 14 and groove 15 extend over the full effective length of gaps 10 and 11, respectively. Slits 14 and grooves 15 are provided on both sides of rotor 4 in the double-pass designed rotor illustrated in FIGS. 1 and 3. As indicated by the dashed lines in FIG. 3, passageways 14–15 are circumferentially staggered such as to alternate on opposite sides of rotor 4 to avoid an unacceptable weakening and corresponding reduction in the mechanical strength of rotor 4.

Figure 4:
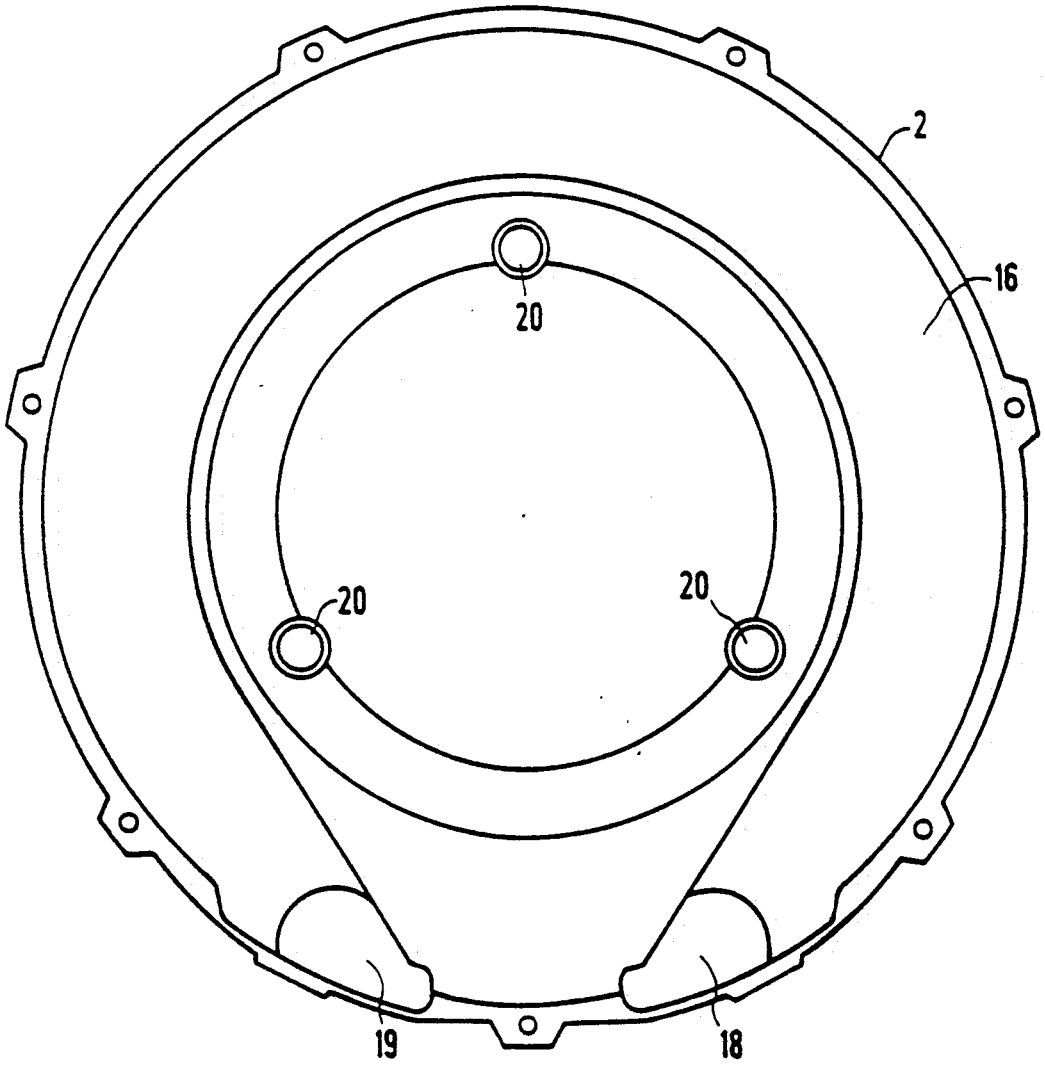
FIG. 4 is a top view of one of the members forming the housing of the side-channel compressor depicted in FIG. 1.

Due to the pressure difference between the area bordering outlet orifice 18 and the area bordering inlet opening 19 shown in FIG. 4, gas leaks therebetween. Specifically, a leakage gas flows from the area bordering outlet orifice 18 to the area bordering inlet opening 19 through gaps 10 and 11. Consequently, in the vicinity of outlet orifice 18, leakage gas flows from side-channel 16 into the cavity formed between the housing and the rotor and designated with reference numeral 17. Then, the leakage gas returns from cavity 17 to side channel 16 in the vicinity of inlet opening 19.

Each slit 14 and corresponding groove 15 effectively represent an expansion of the boundaries of gaps 10 and 11. It also may be said that slits 14, as well as grooves 15, form an extension of gaps 10 and 11. Thus, a more substantial leakage current can develop in the vicinity of slits 14 and grooves 15. As a result, leakage gas flows at a higher velocity along slits 14 and grooves 15. Accordingly, dust, lint or fiber-like particles which have reached cavity 17 in the vicinity of inlet opening 19 are conveyed back through groove 15 and slit 14 and returned to side channel 16. Furthermore, such particulate settling in radial and axial gaps 10 and 11 is carried away along slits 14 and grooves 15 by the current of leakage gas. Consequently, slits 14 and grooves 15 prevent the accumulation of particulate deposits in gaps 10 and 11, which otherwise could become completely obstructed with particulate thereby creating large friction forces that could eventually block the rotor or prevent restarting the rotor after an intermission in operation.

Figure 2:
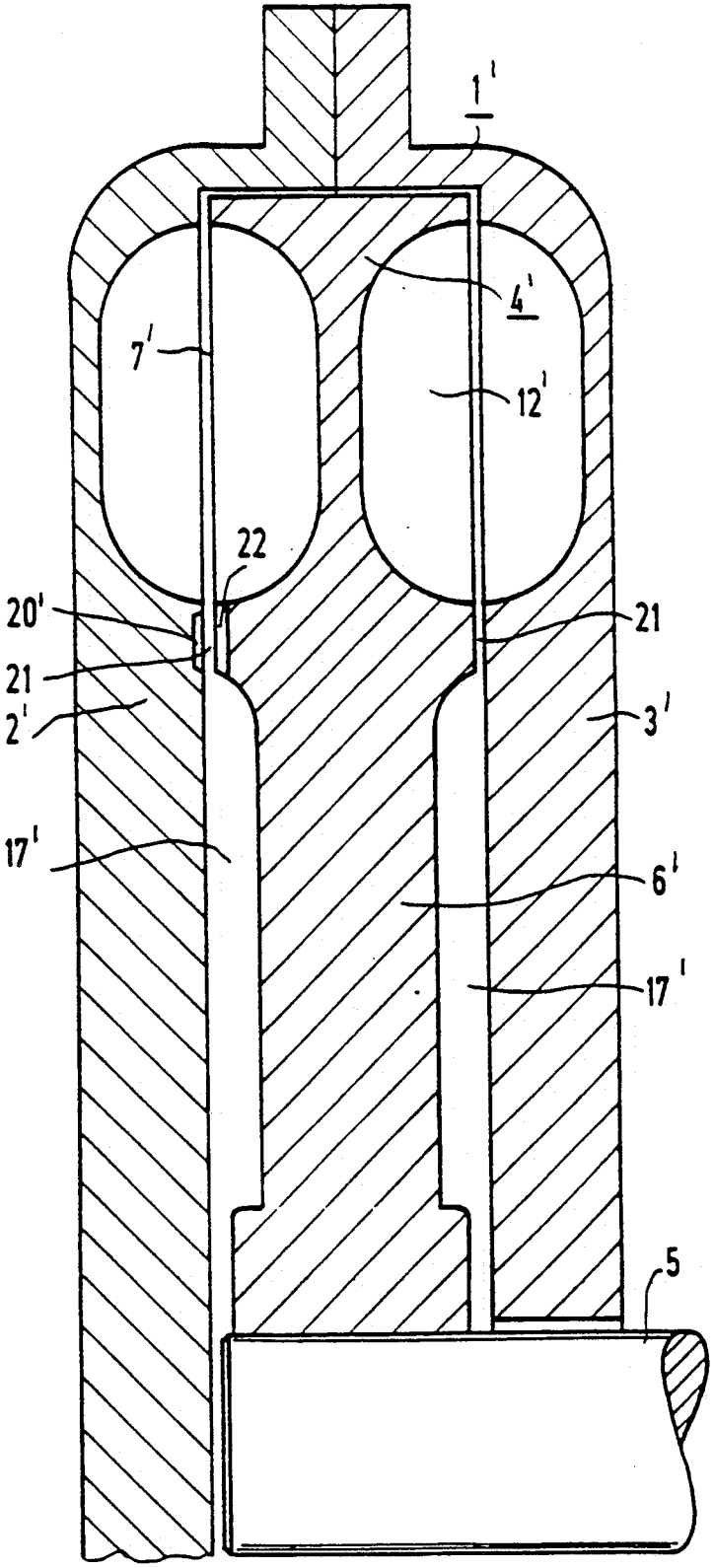
FIG. 2 is a cross-sectional view of a partial section of another embodiment of a side-channel compressor in accordance with the present invention.

In accordance with another feature of the present invention, counterbores 20 are formed in the housing to prevent dirt from being deposited in slits 14 and grooves 15, and thus to prevent blocking of passageways 14–15 (FIGS. 1 and 2). Although counterbores 20 only are illustrated in housing member 2, they are formed in both housing members 2 and 3 with their open ends facing and in fluid communication with axial gap 11. Furthermore, counterbores 20 extend in the radial direction of the compressor more or less over the radial length of grooves 15. Each counterbore 20 also extends in the circumferential direction a distance several times the width of grooves 15. Due to the above arrangement counterbores 20 cause the flow of leakage gas through grooves 15 to be turbulent. Thus, as leakage gas flows through passageways 14–15, particles are prevented from being deposited in grooves 15 by the turbulence developed therein. This turbulence also has a reciprocal action on counterbores 20 which prevents the accumulation of particulate therein. Another advantageous aspect of counterbores 20 is that they have a round design, and thus can be easily manufactured.

A further embodiment of the present invention is shown in FIG. 2. In this embodiment, housing halves 2′ and 3′ do not pass directly underneath blade ring 7′ of impeller or rotor 4′. More specifically, housing halves 2′ and 3′ do not include lateral sections that laterally extend in the vicinity of the juncture of blade ring portion 7′ and hub portion 6′. Thus, only narrow axial gap 21 is present in the area where blade ring portion 7′ merges into hub portion 6′ of rotor 4′. In this area, groove 22 is provided in rotor 4′ to run parallel to axial gap 21. Thus, groove 22 functions like previously described slit 14 and groove 15. Both sides of rotor 4′ can be provided with several circumferentially distributed grooves 22. Furthermore, the walls of housing halves 2′ and 3′ can be provided with counterbores 20′ which correspond in configuration and function to previously described counterbores 20.

What is claimed is:

1. A double-pass side-channel compressor comprising:

a housing;

a rotor rotatably supported in said housing for rotating about an axis, said rotor comprising a central disk-shaped hub and a blade ring arranged at the outer circumference of said hub;

a clearance space formed between said housing and said rotor in the vicinity where said hub merges into said blade ring;

a plurality of recesses formed in said rotor in said vicinity where said hub merges into said blade ring, each recess extending over the entire effective length of said clearance space in said vicinity where said hub merges into said blade ring and including a groove formed in said disk-shaped hub, each recess effectively forming an extension of said clearance space; and at least one counterbore that is formed in said houisng and extends in the circumferential direction a distance several times the width of said groove, said counterbore having an opening facing said clearance space and said disk-shaped hub.

2. A double-pass side-channel compressor comprising:

a housing;

a rotor rotatably supported in said housing for rotating about an axis, said rotor including a central disk-shaped hub and a blade ring arranged at the outer circumference of said hub, said blade ring including a portion that extends laterally beyond at least one side of said hub in the direction of said axis of rotation of said rotor and said housing including a section that extends beneath said laterally extending blade ring portion, said blade ring further including a plurality of blades and blade cells which are formed between adjacent blades and which include a base adjacent to said disk-shaped hub;

a clearance space formed between said housing and said rotor in the vicinity where said hub merges into said blade ring, said clearance space including a narrow axial gap and a narrow radial, gap, said laterally extending blade ring portion being spaced from said housing section to form said narrow radial gap;

a plurality of recesses formed in said rotor in said vicinity where said hub merges into said blade ring, each recess extending over the entire effective length of said clearance space in said vicinity where said hub merges into said blade ring and effectively forming an extension of said clearance space, each recess including a slit that is provided at the base of one of said blade cells and a groove that is formed in said disk-shaped hub and extends parallel to said axial gap, said slit extending to said radial gap and said groove; and at least one counterbore that is formed in said housing and extends in the circumferential direction a distance several times the width of said groove, said counterbore having an opening face said clearance space and said disk-shaped hub.

3. A side-channel compressor comprising:

a housing;

a rotor rotatably supported in said housing for rotating about an axis, said rotor including a central disk-shaped hub and a blade ring arranged at the outer circumference of said hub, said blade including a portion that extends laterally beyond at least one side of said hub in the direction of said axis of rotation of said rotor and said housing including a section that extends beneath said laterally extending blade ring portion, said blade ring further including a plurality of blades and blade cells which are formed between adjacent blades and which include a base adjacent to said disk-shaped hub;

a clearance space formed between said housing and said rotor in the vicinity where said hub merges into said blade ring, said clearance space including a narrow axial gap and a narrow radial gap, said laterally extending blade ring portion being spaced from said housing section to form said narrow radial gap;

at least one recess formed in said rotor in said vicinity where said hub merges into said blade ring, each recess extending over the entire effective length of said clearance space in said vicinity where said hub merges into said blade ring and effectively forming an extension of said clearance space, each recess including a slit that is provided at the base of one of said blade cells and a groove that is formed in said disk-shaped hub and extends parallel to said axial gap, said slit extending to said radial gap and said groove; and at least one counterbore that is formed in said housing and extends in the circumferential direction a distance several times the width of said groove, said counterbore having an opening facing said clearance space and said disk-shaped hub.

4. A side-channel compressor comprising:

a housing;

a rotor rotatably supported in said housing for rotating about an axis, said rotor comprising a central disk-shaped hub and a blade arranged at the outer circumference of said hub;

a clearance space formed between said housing and said rotor in the vicinity where said hub merges into said blade ring;

at least one recess formed in said rotor in said vicinity where said hub merges into said blade ring, said recess extending over the entire effective length of said clearance space in said vicinity where said hub merges into said blade ring and including a groove formed in said disk-shaped hub, said recess effectively forming an extension of said clearance space; and at least one counterbore that is formed in said housing and extends in the circumferential direction a distance several times the width of said groove, said counterbore having an opening facing said clearance space and said disk-shaped hub.

* * * * *